US008413952B2

(12) United States Patent
Lang et al.

(10) Patent No.: US 8,413,952 B2
(45) Date of Patent: Apr. 9, 2013

(54) METHOD FOR CONTROLLING THE WATER SUPPLY IN A SANITARY INSTALLATION

(75) Inventors: Edo Lang, Trimmis (CH); Roland Obrist, Scharans (CH)

(73) Assignee: Oblamatik AG, Chur (CH)

( * ) Notice: Subject to any disclaimer, the term of this patent is extended or adjusted under 35 U.S.C. 154(b) by 842 days.

(21) Appl. No.: 12/479,551

(22) Filed: Jun. 5, 2009

(65) Prior Publication Data

US 2009/0288712 A1 Nov. 26, 2009

Related U.S. Application Data

(63) Continuation-in-part of application No. 10/548,554, filed on Jan. 10, 2006, now abandoned.

(30) Foreign Application Priority Data

Mar. 11, 2003 (CH) ..... 0381/03

(51) Int. Cl.
*F16K 31/02* (2006.01)

(52) U.S. Cl.
USPC ..... 251/129.04

(58) Field of Classification Search ..... 251/129.04; 4/675–678; 137/801
See application file for complete search history.

(56) References Cited

U.S. PATENT DOCUMENTS

| | | | | |
|---|---|---|---|---|
| 3,576,277 | A * | 4/1971 | Blackman | 222/1 |
| 3,638,680 | A * | 2/1972 | Kopp | 137/606 |
| 5,031,258 | A | 7/1991 | Shaw | |
| 5,095,945 | A | 3/1992 | Jensen | |
| RE37,888 | E | 10/2002 | Cretu-Petra | |
| 6,619,320 | B2 * | 9/2003 | Parsons | 137/624.11 |

FOREIGN PATENT DOCUMENTS

| | | |
|---|---|---|
| DE | 3516440 | 5/1985 |
| DE | 19651132 | 12/1996 |
| DE | 19815324 | 4/1998 |
| FR | 2706504 | 12/1994 |
| WO | WO 93/10311 | 5/1993 |
| WO | WO 02/29168 | 4/2002 |

* cited by examiner

*Primary Examiner* — John K Fristoe, Jr.
*Assistant Examiner* — Andrew J Rost
(74) *Attorney, Agent, or Firm* — Notaro, Michalos & Zaccaria P.C.

(57) ABSTRACT

A method and a computer program product controls the water supply in a sanitary installation having a cold water supply line and a hot water supply line, a valve battery, which is connected to a power supply, and a sensor unit connected to the power supply. At least one trigger means outputs an action signal to an electronic controller when activated by a user by tapping on the trigger means that is embodied as a switch or by at least partially penetrating into the detection area of a trigger means that is embodied as a proximity sensor.

22 Claims, 2 Drawing Sheets

METHOD FOR CONTROLLING THE WATER SUPPLY IN A SANITARY INSTALLATION

RELATED PATENT APPLICATIONS

This continuation-in-part application claims priority from U.S. patent application Ser. No. 10/548,554, which, in turn, claims priority from International Application Serial No. PCT/CH2004/000113 filed on Mar. 2, 2005, which, in turn, claims priority from Swiss Patent Application Serial No. 381/03 filed on Mar. 11, 2003. The entire content of these prior applications is incorporated herein by reference.

FIELD OF THE INVENTION

The present invention relates to methods for controlling the water supply in a sanitary installation and a corresponding computer program product.

BACKGROUND OF THE INVENTION

According to DE 19015324, fittings are referred to as automatic fittings if the water supply of a washstand fitting is controlled via an external solenoid valve and the existing fitting is only still used for preselecting the mixing ratio and as a sensor.

DE 19651132 also discloses an automatic fitting, which is equipped with a sensor unit and a control unit as a proximity fitting. A valve unit and/or a valve battery is connected to the control unit, the control unit activating the valve unit to release water after registering a signal through the sensor unit. In this special case, the release of cold water or hot water is caused upon registering a signal detected by the infrared sensors from a specific side.

A further proximity fitting is known from WO 93/10311. A proximity sensor detects the hand of the user and releases the water supply. After the passage of a time interval, a soap portion is dispensed and the washing procedure is registered.

Another automatic fitting is known from DE 3516440. This arrangement having a panel of monitoring sensors allows the contactless regulation of the supply and/or the mixing ratio of hot and cold water. A fixed temperature and/or discharge quantity value is assigned to every monitoring sensor, which work hierarchically with one another.

A further automatic fitting is known from WO 02/29168. This is a device for controlling a medium supply having a sensor device for contactless determination of the presence and position of a hand of the user, the sensor device establishing an electrical charge transfer.

In addition, an electronic control for a water tap, a nozzle, and the like is known from U.S. Pat. No. 5,095,945 to Jensen. Water inlets are all equipped with solenoid valves, which are controlled via a logical controller. This controller is connected to a detector, which detects the proximity of a user hand and provides an output signal which causes the controller to run through a sequence of selected temperatures and time limits until the user—upon reaching a desired temperature and duration—moves his hand out of the proximity of the sensor. The controller then outputs signals to the solenoid valves so that these allow water to flow through the inlets into the water distributor and from there to the tap, the nozzle, etc. in accordance with the selected temperature and duration. The user is always offered the identical series of selection possibilities. This series is displayed by LED and must be run through every time until the system displays the desired parameter combination. The user must pull back his hand in this moment and the system releases water corresponding to the selected parameters. Therefore, the water removal is programmed without water flowing. The detection system disclosed comprises an infrared transmitter (LED) and an infrared receiver (photodiode) and is based on the detection of the infrared light reflected in the sensor.

FR 2706504 discloses a further electronic fitting controller having a presence detector, at least one electronic valve, and an electronic circuit which allows the presence detector to generate control signals, which processes the response signal in accordance with the detection of presence or absence and which triggers the opening or closing of the electronic valve 7. A pulsed, active infrared sensor and a comparison of the detected infrared light to a threshold value is disclosed. Setting or changing a temperature and/or a flow value is not disclosed.

Most of these known automatic fittings and/or their controllers are constructed very simply and allow only the supply of a previously determined water temperature and/or of hot or cold water (e.g., FR 2706504). Few of the known automatic fittings also allow the adjustment of the water temperature (e.g., U.S. Pat. No. 5,095,945), and such fittings and/or their controllers usually have quite complex constructions and are therefore costly. The operation of the controllers, which are often complex, is rather difficult to understand or cumbersome for a first-time user. Additional selection handles or even touch screens for setting water temperature and/or water flow may simplify the operation, but make the fitting more expensive.

U.S. Pat. No. RE 37,888E to Cretu-Petra discloses a water faucet with touchless control of water temperature and water flow adjustment. The assembly comprises a water mixing valve and three touchless proximity sensors. Each one of these proximity sensors is located at the faucet behind an individual lens. A first one of these sensors is accomplished for switching on and off the water flow, a second one of these sensors is accomplished to control the water flow, and a third one is utilized for controlling the water temperature. All sensors detect hand movements in the proximity of the sensors by the reflexion of infrared light which they emit. Using these sensors by adjusting a certain distance between the hand and the sensor, a certain temperature or flow of the water can be adjusted. This reference discloses that pre-programmed settings of flow and temperature can be accessed with defined commands. At col. 10, lines 2-6, it is taught that adjustment of these settings also can be made while water is flowing into the faucet. At col. 8, lines 42-45, it is taught that, after activation of the on/off sensor the water supply is stopped after a certain pre-selected time. Cretu-Petra fails to provide a teaching, however, regarding an individual time slot that is assigned to each action signal and that is utilized to control the flow and/or temperature of water.

The control of water flow and temperature according to Cretu-Petra is based on a continuous movement of the user's hand with respect to the infrared sensor in each case. The signal initiated by such movements is also continuous as long as the hand rests inside the field of detection of the respective sensor. Thus, there is a need for a device that provides punctual and discontinuous action signals, to the end of which a time slot can be easily assigned. The continuous control taught by Cretu-Petra does not allow for the definition of such a time slot, the time slot being individually assigned to each action signal that is triggered by a trigger means.

U.S. Pat. No. 5,031,258 to Shaw discloses a wash station and with an electrically activatable valve on the tap. On or at the faucet of this wash station, there is located an infrared sensor which detects the presence of a user's hands. In order to avoid unintentional activation of the wash station, the sensor must be activated over a certain time span. Then, the wash table can be used in a "normal" or "automatic" mode. In order to utilize the "automatic" mode, the user needs to move his hands in the detection field of the sensor and within a defined time interval (see col. 8, lines 25-32). In case of lack of such detectable movement, the station changes to the "normal" mode. Shaw is silent about an individual time slot that is assigned to each action signal and that is utilized to control the flow and/or temperature of water.

SUMMARY OF THE INVENTION

An object of the present invention is to suggest an alternative method for controlling the water supply in a sanitary fitting having a cold water supply line and a hot water supply line, which allows high control comfort even with very simply constructed facilities.

This object is achieved according to a first and second aspect by a method and computer program product as herein described.

The method for controlling the water supply in a wash basin and/or in a sanitary installation has the advantage in relation to the proximity fitting known from DE 19651132 in that the water temperature and/or the flow value may be changed even when the valve battery is open.

BRIEF OVERVIEW OF THE DRAWINGS

The present invention will be explained in greater detail on the basis of schematic, exemplary figures, without restricting its scope.

DESCRIPTION OF THE PREFERRED EMBODIMENTS

Figure 1:
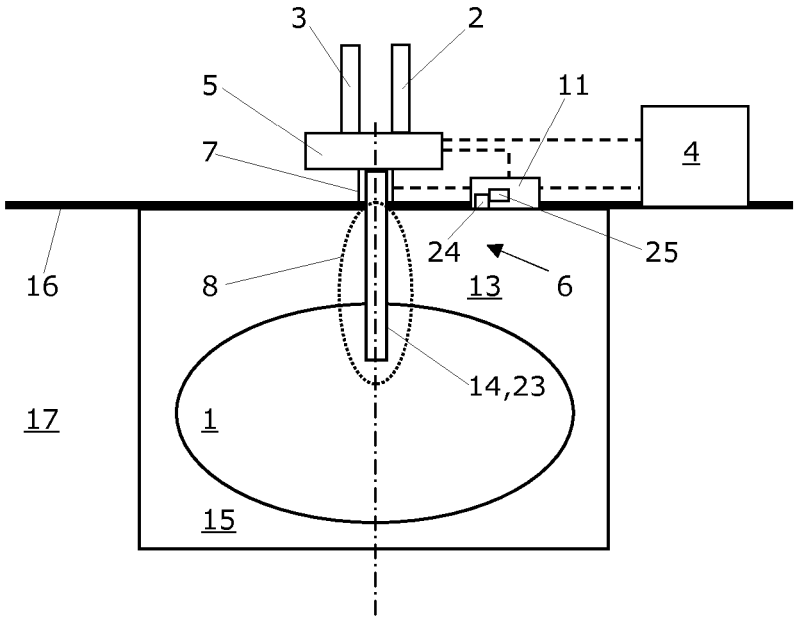
FIG. 1 shows a top view of an arrangement for performing the method according to the present invention according to a first embodiment.

FIG. 1 shows a sanitary installation 1 according to a first embodiment, having a cold water supply line 2 and a hot water supply line 3 and having a valve battery 5, which is connected to a power supply 4, for opening and/or mixing the water supply from these two water supply lines. In general, in connection with the present invention, the term "sanitary installation" is to be understood as representing and as a synonym of wash basins, bathtubs, showers, sinks, and the like. Accordingly, all statements which are made for wash basins also relate correspondingly to all other sanitary installations, such as bathtubs, showers, sinks, and the like. This sanitary installation and/or this wash basin is equipped with a sensor unit 6, which is connected to a—preferably central—power supply, for controlling the water supply therein. This power supply may alternately be implemented as an AC or DC network, a battery, and/or an accumulator. A DC bus network is especially preferred.

The sensor unit 6 comprises at least one trigger means, preferably in the form of a proximity sensor 7 having a detection area 8. The sensor unit 6 may be constructed alternately on an optical, acoustic, capacitive, radar, or inductive functional principle. The functional principle referred to by this applicant as the "DDSA principle" is cited here as an especially preferred embodiment of a capacitive principle, in which a sensor device comprises a first capacitor (C2), having a first and second electrically conductive surface and a dielectric layer. Furthermore, the DDSA sensor device comprises a conductive absorption surface which is connected in a conductive way to the first surface of the first capacitor (C2), an AC voltage generator (G), for coupling an AC voltage signal (s1(t)) into the absorption surface and a sensor amplifier (A) for amplifying an output signal (s2(t)), which may be tapped at the second surface of the first capacitor (C2). In this case, the DDSA sensor device is designed so that the absorption surface forms an additional capacitor (C3) upon approach of an object, whose effective capacitance is changeable, and the output signal (s2(t)) experiences damping, which is detectable, due to this effective capacitance. The proximity sensor 7 of such a DDSA sensor device is preferably installed together with a water tap 14 in a wash basin 1, so that the water tap is used as the absorption surface.

Very generally, action signals 9, 9', 9", 10, 10' are generated when the hands or other body parts penetrate into and remain in the detection area 8 or when the hands penetrate into the detection area 8 one or more times within a predefined time frame. The detection area also includes contacting the proximity sensor 7 and/or a surface 23 operatively linked to the sensor unit 6.

This action signal differs in potential and/or quality from a rest signal 12, which the proximity sensor 7 outputs, without action of a user on the detection area 8, to the controller 11, which is also connected to the power supply 4. To save energy, the rest signal may be pulsed, however, a permanent rest signal 12 which the sensor unit 6 outputs to the electronic controller 11 is preferred.

The method according to the present invention is distinguished in that the controller 11—by registering and processing a specific number of action signals 9, 9', 10, 10' triggered by a user—brings the valve battery 5 into a position corresponding to this number of action signals 9, 9', 10, 10', through which cold water, hot water, or mixed water of a predefined temperature and/or having a predefined flow value is introduced into the wash basin 1.

In an alternative, also preferred embodiment, the sensor unit 6 that is connected to the power supply, comprises at least one trigger means. This trigger means is accomplished as a movable switch that induces output signals. Most preferably, the output signals are digital output signals. The trigger means can be accomplished e.g. as a travel contactor or shifting pushbutton that works on a reed-contact principle when travelling a certain distance or that works on a piezo principle when a pressure is applied to the switch. A person of skill in the art would be able to select the appropriate type of trigger means once he or she has grasped the essence of the present invention. Such a trigger means outputs an action signal to an electronic controller, which is connected to the sensor unit and the valve battery when a person taps on the trigger means. In the context of the present invention, such tapping is to be understood as exerting some force to the trigger means or switch in order to force it to generate an output signal. Also in this alternative embodiment, an individual time slot is assigned to every action signal and the controller, after at least one further action signal which is triggered within such a time slot through repeated tapping on the trigger means, outputs a command which causes the valve battery to change the temperature and/or the flow value of the water supply to the sanitary installation in relation to the number of further action signals triggered by these multiple taps on the trigger means, and, after expiration of the last individual time slot, to release the supply of water of the selected temperature and/or the selected flow value into the sanitary installation. The selection of such a trigger means is especially preferred when a simple and cheap solution for inducing or outputting action signals is to be found.

Figure 2:
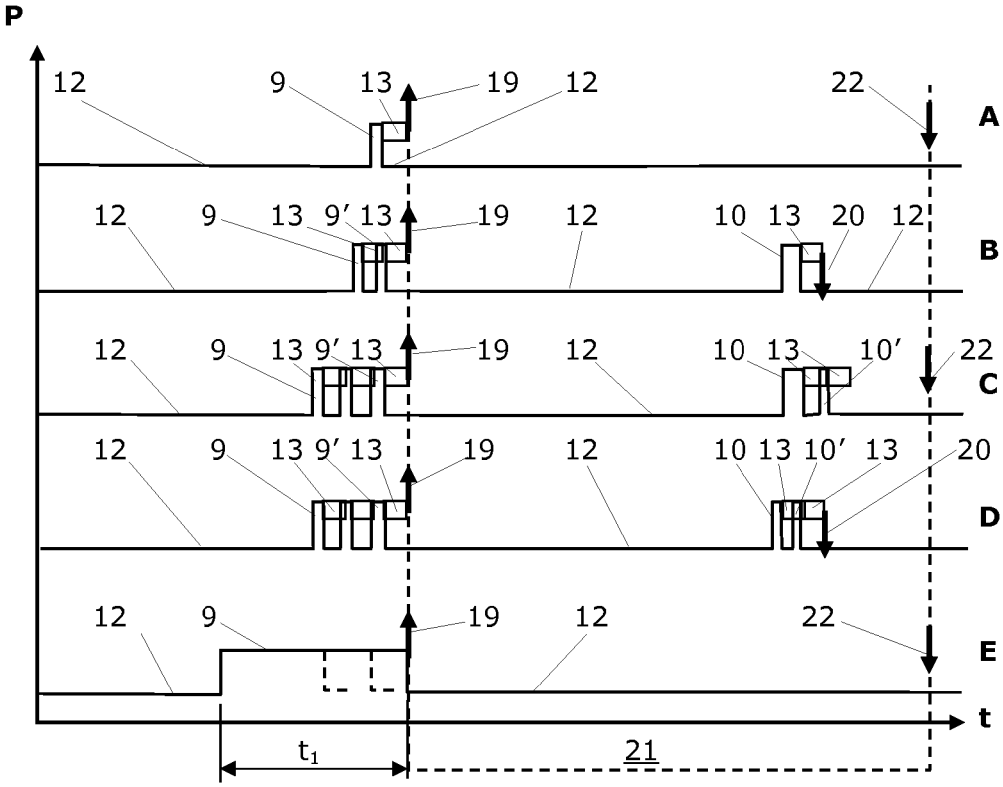
FIG. 2 shows an illustration of signals of a proximity sensor according to the method according to the present invention.

FIG. 2 shows an illustration of signals of a proximity sensor 7 according to the method of the present invention. This is a schematic diagram in which the potential (p) of the output at the proximity sensor 7 is plotted as a function of the time (t) for the exemplary variations A-H. All action signals are represented here as potential changes and comprise—each starting from a rest potential 12—a rise and a fall of the potential. As an alternative to this representation, the potential change of the action signal may also be continued over a longer time ($t_1$), through the hands remaining in the detection area 8, the duration of this potential change being analyzed as the action signal. Very generally, an action signal may also be composed of a fall and a subsequent rise of the potential.

It is important that the potential change may be identified perfectly by the controller 11 and interpreted as an action signal. Fixing corresponding threshold values and/or using smoothing methods for the sensor signals are known per se.

An individual time slot 13, which is possibly assigned to each action signal 9, 9', 9", 10, 10', is especially preferred. If a further action signal 9', 10' is triggered within such a time slot 13, this situation is converted by the controller, which comprises a computer 25, into a command which causes the valve battery 5 to change the temperature and/or the flow value of the water supply to the wash basin 1 in relation to the number of further action signals 9', 10'. This change may be an increase or a reduction of water temperature and/or flow value.

A corresponding computer program for controlling the water supply is loadable in this computer 25, which is distinguished in that it allows the controller 11 to register a specific number of these action signals 9, 9', 9", 10, 10', which are triggered by a user, or their duration, process them, and output corresponding control signals to the valve battery 5, which assumes a position corresponding to these control signals, through which cold water, hot water, or mixed water of a predefined temperature and/or having a predefined flow value is introduced into the wash basin 1.

A variable time interval 21 starts directly after the expiration of the last individual time slot 13 with the opening 19 of the valve battery 5. After expiration of the variable time interval 21, which is determined by the action signals 10, 10' and/or by a predefined time interval $t_1$, cold water rinsing may possibly subsequently be performed automatically within a predefined time interval, by only opening the cold water valve. This has the essential advantage that the bacteria production may be minimized in the riser line (not shown) between the valve battery 5 and the outlet of the water tap. This is especially advantageous for the medical field and also for the field of food processing.

If a person triggers a continuous signal of the sensor 7 which exceeds a predefined time threshold, a cleaning mode is activated (not shown in FIG. 2).

This controller 11 is specially designed for the use of wash basins 1 in sports stadiums and public toilets and in technical and medical laboratories, medical practices, and hospitals. It has been shown that the present invention is also usable in the area of private and public bathrooms (baths, showers) and in the kitchen area in general. As a result, the individual time slot 13 may vary between a few seconds and several minutes. Shorter time slots of less than a few seconds are also conceivable. The water temperature may be restricted to cold water or may comprise one or many hot water temperatures, which may be set in steps—e.g., in steps of +/−5° C. It is important in any case that no temperature which could result in injuries to the user may be set.

Selected operating examples are schematically illustrated in FIG. 2:

Case A

A user triggers a first action signal 9 by approaching or contacting the water tap 14, which functions as the surface 23 operatively linked to the sensor unit 6 in FIG. 1. Before and after the action signal 9, the proximity sensor 7 transmits a rest signal 12 to the controller. Since there is no further action signal within the individual time slot 13, the valve battery 5 is opened.

Because this controller 11 has only received one action signal 9, the valve battery 5 is instructed to allow water having a first temperature and/or a first flow rate to flow into the wash basin (element 19 of FIG. 2). This first temperature may be cold water, hot water, or a specific mixed value of cold and hot water.

Because the user leaves the wash basin without triggering a further action signal, the controller 11 automatically interrupts the water supply at the end 22 of the variable time interval 21 through a closing command to the valve battery 5.

Case B

A person triggers a first action signal 9 by approaching or contacting the water tap 14, which functions as the surface 23 operatively linked to the sensor unit 6 in FIG. 1. Before and after the action signal 9, the proximity sensor 7 transmits a rest signal 12 to the controller. Within the individual time slot 13 of the first action signal 9, this person triggers a further action signal 9'. Since no further action signal occurred within the last individual time slot 13, the valve battery 5 is opened (element 19 of FIG. 2). Because this controller 11 has received two action signals 9, 9' in the first time interval, the valve battery 5 is instructed to allow water having a second temperature and/or a second flow rate to flow into the wash basin. This second temperature may be higher or lower than a first temperature by a specific value (compare Case A).

This person triggers a further action signal 10 within the variable time interval 21, upon which the controller 11 interrupts the water supply through a closing command to the valve battery 5 (arrow 20) and ends the time interval 21.

Case C

A person triggers a first action signal 9 by approaching or contacting the water tap 14, which functions as the surface 23 operatively linked to the sensor unit 6 in FIG. 1. Before and after the action signal 9, the proximity sensor 7 transmits a rest signal 12 to the controller. Within the individual time slot 13 of the first action signal 9, this person triggers a further action signal 9'. Within the individual time slot 13 of the second action signal 9', this person triggers a further action signal 9'. Since no further action signal occurred within the last individual time slot 13, the valve battery 5 is opened (arrow 19 in FIG. 2).

Because this controller 11 has received three action signals 9, 9' in the first time interval, the valve battery 5 is instructed to allow water having a third temperature and/or a third flow rate to flow into the wash basin. This third temperature may be higher or lower than a second temperature by the same value as in Case B. This is also true for a third flow value selected in the same way.

This person triggers a further action signal 10 within the variable time interval 21. This person triggers a further action signal 10 while still within the individual time slot 13 of this further action signal 10. The controller 11 now gives the valve battery 5 the command to allow water having a fourth temperature and/or a fourth flow rate to flow into the wash basin. This fourth temperature may be higher or lower than a second temperature in relation to the first by the same value as in Case B. This is also true for a fourth flow value selected in the same way.

Because the user leaves the wash basin without triggering a further action signal, the controller 11 automatically interrupts the water supply at the end 22 of the variable time interval 21 through a closing command to the valve battery 5.

In this case, the water temperature and/or the flow value was changed by a user while the valve battery 5 was open.

Case D

This case corresponds largely to Case C, but with the difference that the user triggers a further action signal 10' once in the variable time interval 21 while still within the first half of the individual time slot 13 of the preceding action signal 10. The controller 11 now outputs a closing command to the valve battery 5, upon which the controller 11 interrupts the water supply through a closing command to the valve battery 5 (arrow 20) and ends the time interval 21.

Case E

A person triggers an action signal 9, which is a function of $t_1$, by approaching or contacting a water tap 14, which functions as the surface 23 operatively linked to the sensor unit 6 in FIG. 1, the water temperature and/or the flow rate being set by the duration of $t_1$. The duration of $t_1$ may be displayed acoustically and/or visually during the penetration into the detection area 8 and may (as indicated) be of different lengths. The duration $t_1$ preferably corresponds to a single or a multiple of the duration of a selected time unit in this case. Correspondingly, the same effect is preferably caused by activation of the sensor 7 during $t_1$ as by a corresponding repeated triggering of action signals 9, 9'. In this case, the number of complete time units which approximately result in $t_1$ when added together is decisive in this case; a fractional time unit is not considered.

Because the user leaves the wash basin 1 without triggering a further action signal, the controller 11 interrupts the water supply automatically at the end 22 of the variable time interval 21 through a closing command to the valve battery 5.

Figure 3:
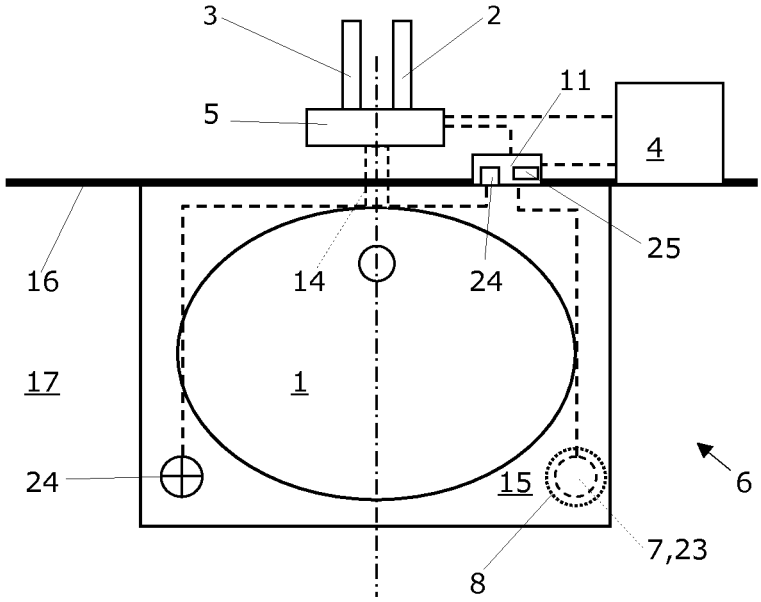
FIG. 3 shows a top view of an arrangement for performing the method according to the present invention according to a second embodiment.

FIG. 3 shows a wash basin 1 according to a second embodiment, which is largely identical to the first embodiment (corresponding parts are each identified using identical reference numbers).

The sensor unit 6 comprises at least one proximity sensor 7 having a detection area 8. The proximity sensor 7 is implemented here as a surface 23 operatively linked to the sensor unit 6 and is located on, in, or directly below the surface of the wash basin wall 15. The detection area covers precisely the area of the surface 23 active as the sensor. This area is preferably identified for the user. This may be performed through color marking or a special relief design (e.g., for the visually impaired). This wash stand 1 and/or the sensor unit 6 comprises display means 24 for displaying the action signals 9, 9', 9", 10, 10'. These display means may be implemented as illuminating color markings or as loudspeakers emitting beeps (e.g., for the visually impaired), every action signal being perceived as a color change and/or a beep, for example.

Figure 4:
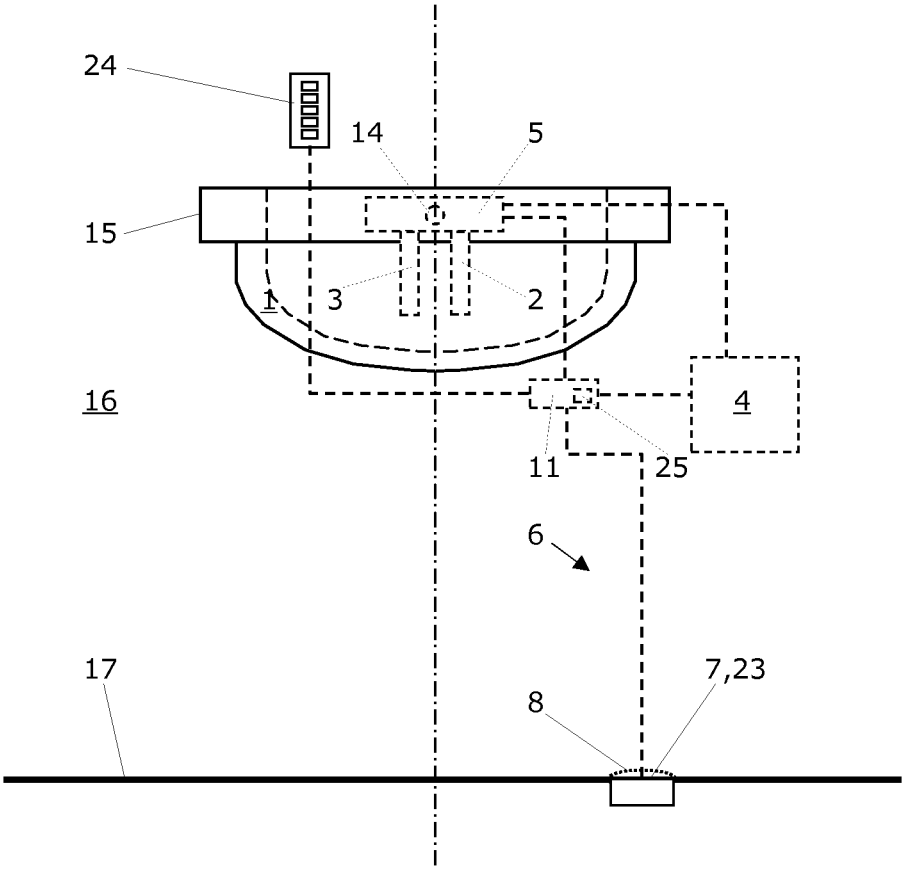
FIG. 4 shows a frontal view of an arrangement for performing the method according to the present invention according to a third embodiment.

FIG. 4 shows a wash basin and/or a sanitary installation 1 according to third embodiment, which is largely identical to the first and/or second embodiment (corresponding parts are each identified using identical reference numbers). The sensor unit 6 comprises at least one proximity sensor 7 having a detection area 8. The proximity sensor 7 is implemented here as a surface 23 operatively linked to the sensor unit 6 and is located on or in the floor 17 below the wash basin 1. The detection area precisely covers the area of the surface 23 active as the sensor. This area is preferably identified for the user, e.g., a handicapped person in a wheelchair. This may be performed through color marking or a special relief design. This wash stand 1 and/or the sensor unit 6 comprises display means 24 for displaying the action signals 9, 9', 9", 10, 10'. These display means may be implemented using illuminating color markings or as a loudspeaker emitting beeps, every action signal being perceived as a color change and/or a beep, for example.

With respect to the alternative embodiments of the sensor unit 6, which comprise at least one trigger means or at least one proximity sensor, all notes and description parts that refer to the a proximity sensor (which also can be used as a touch only sensor), and in particular with respect to inducing or outputting action signals, are analogously applicable to movable and/or press-button and/or piezo trigger devices.

While specific embodiments of the invention have been shown and described in detail to illustrate the application of the principles of the invention, it will be understood that the invention may be embodied otherwise without departing from such principles.

What is claimed is:

1. A method for controlling a water supply in a sanitary installation comprising:

a) a cold water supply line and a hot water supply line;

b) a valve battery, which is connected to a power supply and which is provided for at least partially opening and/or mixing the water supply from the two water supply lines, c) a sensor unit comprising at least one trigger means and being connected to the power supply; and d) an electronic controller that is connected to the sensor unit, to the power supply, and to the valve battery;

wherein the at least one trigger means is connected to the electronic controller and is capable of outputting an action signal to the electronic controller, the action signal differing in potential and/or quality from a rest signal which is outputted by the trigger means to the controller without action of a user on the trigger means;

wherein each time when a user activates the trigger means, an action signal is outputted by the trigger means to the electronic controller, which electronic controller in turn assigns an individual time slot to the action signal and the valve battery is opened, after expiration of a last individual time slot which at least follows a first action signal and within which there is no further action signal, for the duration of a variable time interval, wherein, after at least one further action signal is triggered by a user by repeatedly activating the trigger means within such an individual time slot, the controller outputs a command which causes the valve battery to change a temperature and/or a flow value of the water supply to the sanitary installation in relation to the number of the further action signals triggered by the user and registered and processed by the electronic controller, and wherein, after expiration of the last individual time slot assigned to a last action signal, to release the supply of water of the selected temperature and/or the selected flow value into the sanitary installation.

2. The method of to claim 1, wherein the trigger means is a proximity sensor having a detection area, the proximity sensor inducing and outputting an action signal when a user at least partially penetrates into the detection area.

3. The method of to claim 1, wherein the trigger means is a movable switch, the switch inducing and outputting an action signal when a user taps on the switch.

4. The method according to claim 1, wherein the water supply to the sanitary installation is interrupted in that, at the end of the variable time interval which begins with the opening of the valve battery, the valve battery is automatically closed by the controller.

5. The method according to claim 4, wherein the water supply to the sanitary installation is interrupted and subsequently the cold water valve is turned on over a defined time interval and then turned off again.

6. The method according to claim 1, wherein the sanitary installation is selected from the group consisting of wash basins, bathtubs, showers, and sinks.

7. The method according to claim 1, wherein the sensor unit outputs a permanent rest signal to the electronic controller.

8. The method according to claim 1, wherein the trigger means is positioned together with a water tap.

9. The method according to claim 8, wherein the sensor unit is constructed on a capacitive DDSA principle, and the water tap is used as the absorption area.

10. The method according to claim 8, wherein the action signals are triggered by contacting a surface which is operatively linked to the sensor unit.

11. The method according to claim 10, wherein the operatively linked surface is the water tap.

12. The method according to claim 1, wherein the trigger means is installed in a location selected from the group consisting of a wall of the sanitary installation, a wall behind the sanitary installation, a wall next to the sanitary installation, and the floor below the sanitary installation.

13. The method according to claim 1, wherein the sensor unit and trigger means is constructed on a functional principle selected from the group consisting of optical, acoustic, capacitive, radar, and inductive.

14. The method according to claim 1, wherein a cleaning mode is initiated by an action signal of the trigger means of a length of time sufficient to initiate the cleaning mode.

15. The method according to claim 1, wherein the water supply to the sanitary installation is interrupted by closing the valve battery, in response to one or two action signals being triggered.

16. The method according to claim 1, wherein the temperature and/or the flow value of the water flowing in the sanitary installation is changed by one step per further action signal with the triggering of at least one further action signal of the trigger means during the variable time interval and within the particular last individual time slot of an action signal.

17. The method according to claim 1, wherein the action signals are optically communicated to the user via a display means.

18. The method according to claim 1, wherein the action signals are acoustically communicated to the user.

19. The method according to claim 1, wherein the power supply is selected from the group consisting of AC or DC network, a battery, and an accumulator.

20. The method according to claim 1, wherein after a disconnection of the controller from the power supply and/or after a connection of the controller to the power supply a further time interval starts, during which another control program may be selected.

21. A computer program for controlling the water supply in a sanitary installation which comprises:

a) a cold water supply line and a hot water supply line, b) a valve battery, which is connected to a power supply and which is provided for opening and/or mixing the water supply from the two water supply lines, c) a sensor unit comprising at least one trigger means and being connected to the power supply; and d) an electronic controller that is connected to the sensor unit, to the power supply, and to the valve battery, the electronic controller comprising a computer, into which this computer program is loadable, wherein the at least one trigger means is connected to the electronic controller and is capable of outputting an action signal to the electronic controller, the action signal differing in potential and/or quality from a rest signal which is outputted by the trigger means to the controller without action of a user on the trigger means;

wherein each time when a user activates the trigger means, an action signal is outputted by the trigger means to the electronic controller, the computer program allowing the electronic controller to assign an individual time slot to the action signal and opening of the valve battery, after expiration of a last individual time slot which at least follows a first action signal and within which there is no further action signal, for the duration of a variable time interval, wherein, after at least one further action signal is triggered by a user by repeatedly activating the trigger means within such an individual time slot, the computer program allowing the electronic controller to output a command which causes the valve battery to change a temperature and/or a flow value of the water supply to the sanitary installation in relation to the number of the further action signals triggered by the user and registered and processed by the electronic controller which is enabled by this computer program, and wherein, after expiration of the last individual time slot assigned to a last action signal, the computer program allows the electronic controller to release the supply of water of the selected temperature and/or the selected flow value into the sanitary installation.

22. The computer program according to claim 21, wherein the controller may interrupt the water supply to the sanitary installation, said controller at the end of the variable time interval, which begins with the opening of the valve battery, automatically closing the valve battery.

* * * * *